US007737816B1

(12) United States Patent
Yu

(10) Patent No.: US 7,737,816 B1
(45) Date of Patent: Jun. 15, 2010

(54) DUAL PROTECTION DEVICE FOR CIRCUIT

(76) Inventor: Tsung Mou Yu, No. 4, Alley 2, Lane 23, Sec. 3, Pa Te Road, Panchiao, Taipei Hsien (TW)

( * ) Notice: Subject to any disclaimer, the term of this patent is extended or adjusted under 35 U.S.C. 154(b) by 37 days.

(21) Appl. No.: 12/277,302

(22) Filed: Nov. 25, 2008

(51) Int. Cl.
*H01H 37/12* (2006.01)
*H01H 37/54* (2006.01)

(52) U.S. Cl. ..... 337/142; 337/3; 337/4; 337/13; 337/36; 361/105

(58) Field of Classification Search ..... 337/4, 337/3, 13, 36, 142, 147; 361/105
See application file for complete search history.

(56) References Cited

U.S. PATENT DOCUMENTS 4,319,126 A * 3/1982 Lujic ..... 219/512
4,433,231 A * 2/1984 Balchunas ..... 219/253
4,876,523 A * 10/1989 Kushida et al. ..... 337/299
5,196,820 A * 3/1993 Ubukata et al. ..... 337/368
5,221,914 A * 6/1993 Ubukata et al. ..... 337/13
5,684,447 A * 11/1997 Korczynski et al. ..... 337/5
6,091,315 A * 7/2000 Hofsass ..... 337/13
6,191,680 B1 * 2/2001 Hofsass ..... 337/362
6,741,159 B1 * 5/2004 Kuczynski ..... 337/403
7,075,403 B2 * 7/2006 Unno et al. ..... 337/365
7,209,336 B2 * 4/2007 Yu ..... 361/105
2006/0250209 A1 * 11/2006 Yu ..... 337/36

FOREIGN PATENT DOCUMENTS

EP 1122756 A1 * 8/2001

* cited by examiner

*Primary Examiner*—Anatoly Vortman

(57) ABSTRACT

A dual protection device for a circuit includes a first protection unit and a second protection unit functioning independently. The first protection unit includes an elastic contact piece which has a first contact point. A first conductive member has a second contact point to contact with the first contact point. The elastic contact piece is deformed and bent toward an opposite direction to separate the first contact point from the second contact point when overloaded. A second protection unit has a second conductive member which is connected between the second terminal and the first conductive member. A fuse member and a biasing member are disposed at two opposite sides of the second conductive member. When the fuse member melts due to high temperature, the second conductive member is pushed by the biasing member to be separated from the second terminal.

5 Claims, 7 Drawing Sheets

DUAL PROTECTION DEVICE FOR CIRCUIT

BACKGROUND OF THE INVENTION

1. Field of the Invention

The present invention relates generally to a protection device for a circuit and more particularly, to a dual protection device having two units functioning independently to ensure that the circuit is protected when overloaded, overheated or shorted.

2. The Prior Arts

Electricity plays an import part in everyday life. There are innumerable applications of electricity in the world of today, from computers, home appliances, traffic, and education to entertainment. Therefore, using electricity safely is very important.

Generally speaking, a whole circuit includes a main switch which controls the ON and OFF states of the circuit. The main switch has a fuse and/or a circuit breaker to cut off the circuit and prevent the whole circuit from damage, when the circuit is overloaded, overheated or shorted.

Moreover, the whole circuit may include several sub-circuits and each sub-circuit may have its own switch to control the ON and OFF states. In order to enhance the safety of the circuit, a lot of switches for the sub-circuit are also equipped with protection function. Thus, if the main switch does not function properly or cut off the circuit in time, the switches for the sub-circuits can still protect the whole circuit from over-temperature or over-current.

In addition to the fuses and circuit breakers for the whole circuits, some electric appliances with high power consumption, such as digital processing units, electronic products or heaters, are equipped with individual protection devices to prevent them from damage when these electric appliances are overloaded, overheated or shorted. Once the individual electric appliance is overload, overheat or short, the protection device cuts off the circuit to protect the appliance and avoid damage to other appliances using the same circuit.

Referring to FIGS. 1 and 2, a conventional protection device for individual electric appliance includes a bi-metallic strip 101 which is slightly curved. The bi-metallic strip 101 bends one way if heated, and in the opposite direction if cooled off. One end of the bi-metallic strip 101 is fixed to a first terminal 102 of the electric appliance and the other end of the bi-metallic strip 101 is a free end having a first contact point 103. A second terminal 104 of the electric appliance has a second contact point 105 which is located corresponding to the first contact point 103. When the appliance is in a normal operation state, the first contact point 103 contacts with the second contact points 105 and a closed circuit is formed as shown in FIG. 1. When the circuit is overloaded, overheated or shorted, the temperature of the bi-metallic strip 101 is raised so that the bi-metallic strip 101 is bent toward the other direction and the first contact point 103 is separated from the second contact point 105. The circuit is cut off to become an open circuit and the electric appliance is then prevented from being burned.

However, the conventional bi-metallic strip has the following disadvantages. (1) When manufacturing the bi-metallic strip 101, it is difficult to maintain the precision of the thickness, curvature and configuration of the bi-metallic strip 101. Therefore, the predetermined temperature of the bi-metallic strip 101 to bend is difficult to control. (2) Some of the bimetallic strip 101 is not sensitive enough to the temperature and does not bend to cut off the circuit as expected when the circuit is overloaded. Therefore, the electric appliance and the circuit are not protected from overload, overheat or short. (3) Some of the bi-metallic strip 101 bends but does not completely separate the contact points 103 and 105. The circuit remains as a closed circuit. Thus, the appliance and the circuit are still damaged by overload. (4) Furthermore, some bi-metallic strip 101 does not separate the two contact points 103 and 105 to a sufficient distance. When the temperature slightly cools down, the bi-metallic strip 101 bends to reconnect the two contact points 103 and 105. When the temperature is raised again, the bi-metallic strip 101 bends to separate the two contact points 103 and 105. The repeated connection and separation of the circuit in a short period of time may generate sparks, which may cause fire. It also makes the electric current unstable. Thus, the electric appliance can not function properly and even be damaged.

SUMMARY OF THE INVENTION

A primary objective of the present invention is to provide a dual protection device for a circuit to overcome disadvantages of a conventional protection device that has only one bi-metallic strip to cut off a circuit when overloaded, overheated or shorted. The disadvantages include that the conventional protection device can not cut off the circuit as expected, can not cut off the circuit completely and repeatedly disconnect and connect the circuit.

Another objective of the present invention is to provide a dual protection device for a circuit that includes two protection units functioning independently. The protection units detect the temperature independently. When the circuit is overloaded, the two protection units can cut off the circuit independently. Thus, it ensures the circuit is protected.

Still another objective of the present invention is to provide a dual protection device for a circuit that includes a reusable first protection unit. A bi-metallic strip of the first protection unit bends to cut off the circuit when the circuit is overloaded. When the circuit is cooled down, the bi-metallic strip bends toward the opposite direction. Thus, the circuit becomes a closed circuit again. Because the bi-metallic strip can disconnect and reconnect the circuit, it does not need to replace the first protection unit. It is cost saving.

Further still another objective of the present invention is to provide a dual protection device for a circuit that has a second protection unit. The second protection unit is activated, if the first protection unit does not work as expected and temperature of the circuit is raised to a predetermined value. A fuse member of the second protection unit melts due to high temperature caused by overload, thereby cutting off the circuit to protect the circuit.

In order to achieve the objectives, a dual protection device for a circuit according to the present invention includes a conductive cover, a first protection unit, a second protection unit and a base. The cover has a first terminal connected thereto. The first protection unit includes an elastic contact piece and a first conductive member. The elastic contact piece has a first end fixed to the cover and a second end having a first contact point. The first conductive member is a board and a second contact point is located on the first conductive member. The first contact point is located corresponding to the second contact point. The elastic contact piece is deformed and bent to separate the first contact point from the second contact point when a temperature of the elastic contact piece reaches a predetermined value. The second protection unit includes a second conductive member which is a flexible piece. A first end of the second conductive member is fixed to the first conductive member and a second end of the second conductive member is a free end. A fuse member has one end pressing against the second conductive member to push the free end of the second conductive member to be in contact with a second terminal. If the first protection unit does not function as expected, the temperature of the circuit would keep rising. The fuse member melts when a second predetermined temperature is reached. The free end of the second conductive member is separated from the second terminal, thereby cutting off the circuit. A base has a recess to receive the first conductive member, the second conductive member and the fuse member.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
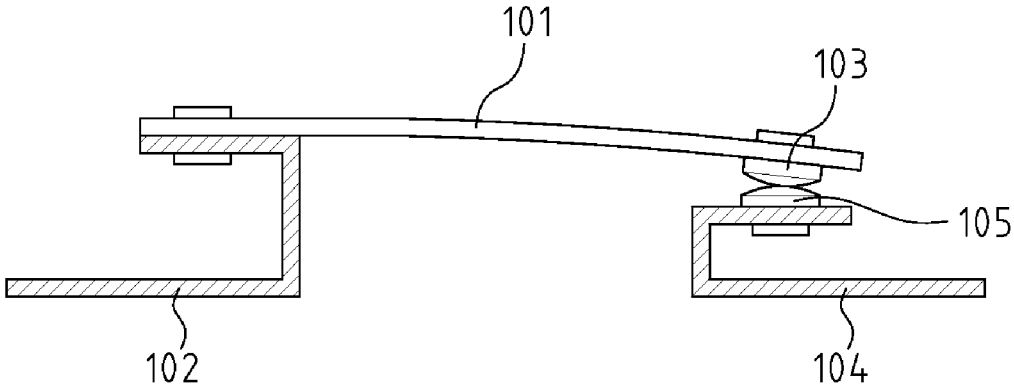
FIG. 1 ( Prior Art )
FIG. 1 is a schematic view showing a conventional protection device for a circuit in a closed circuit.
Figure 2:
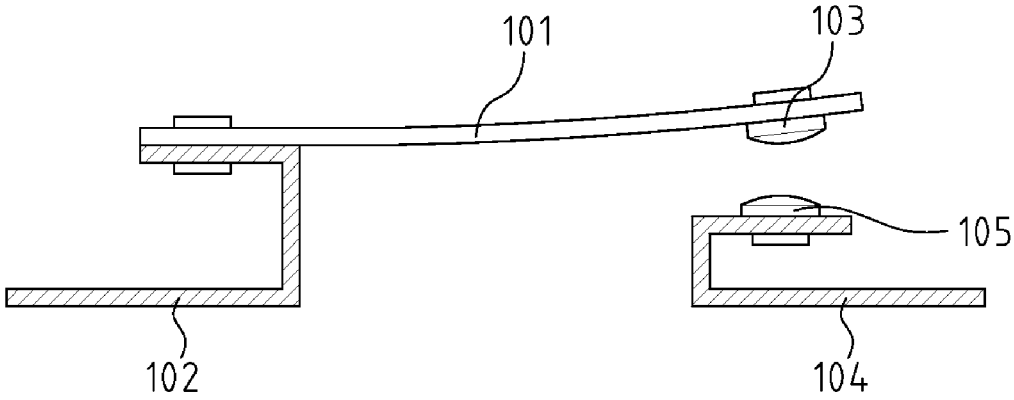
FIG. 2 ( Prior Art )
FIG. 2 is a schematic view showing the conventional protection device for a circuit cutting off the circuit.
Figure 3:
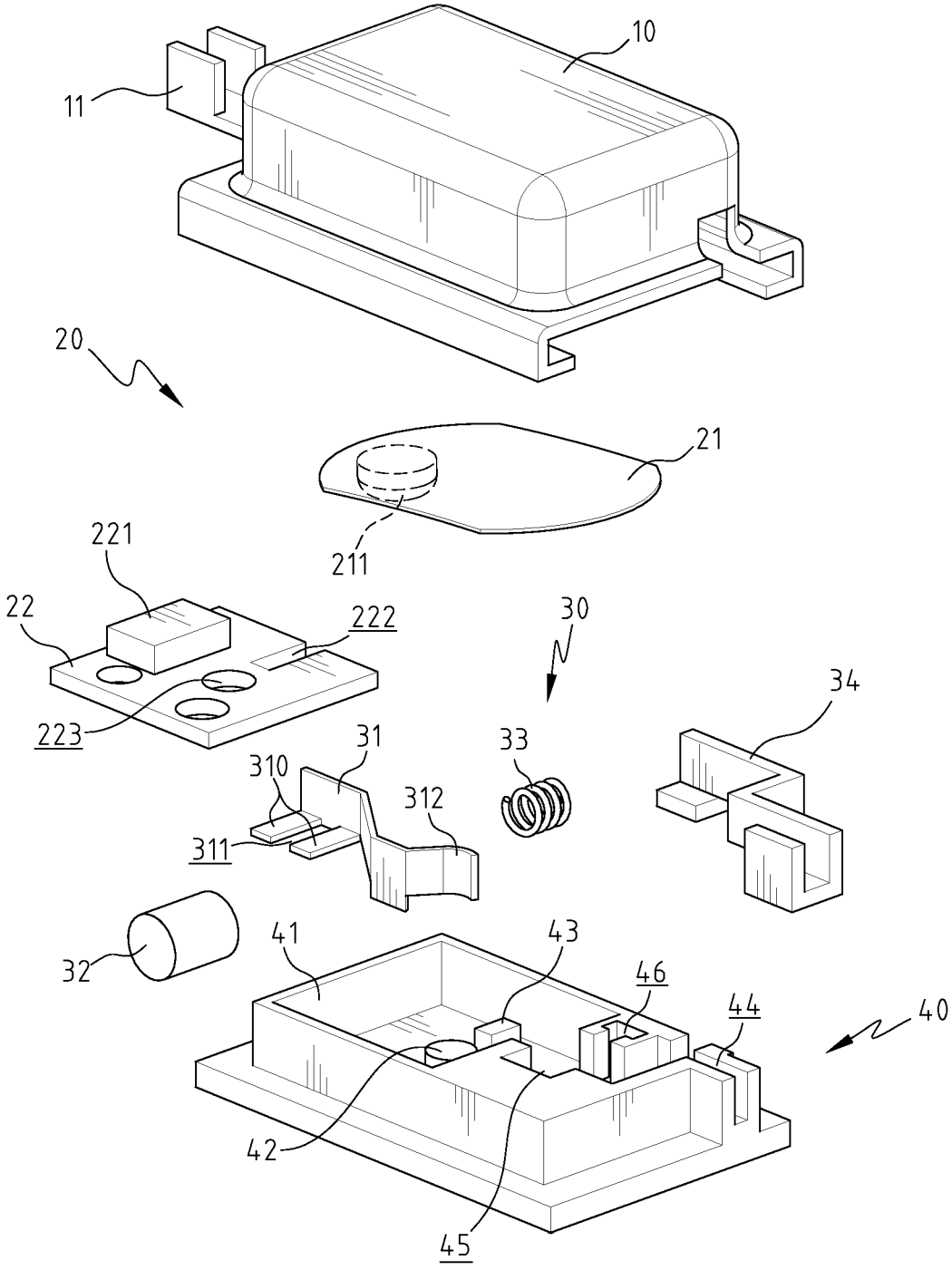
FIG. 3 is an exploded view showing a dual protection device for a circuit according to an embodiment of the present invention.
Figure 4:
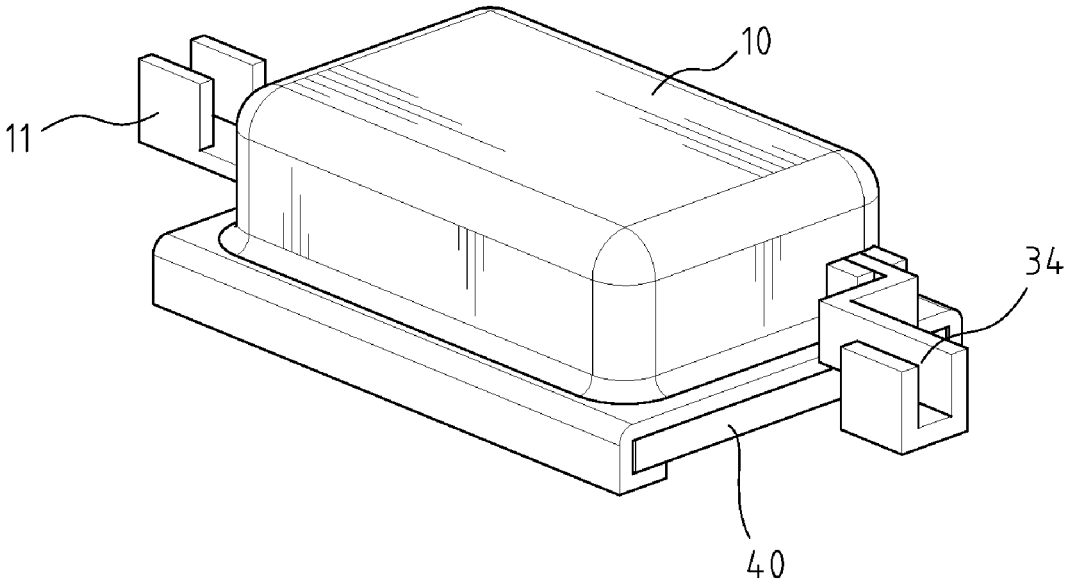
FIG. 4 is a perspective view showing the dual protection device of FIG. 3.

With reference to FIGS. 3 to 6, a dual protection device for a circuit according to the present invention includes a cover 10, a first protection unit 20, a second protection unit 30 and a base 40.

The cover 10 is made of a conductive material and has a first terminal 11 connected thereto.

The first protection unit 20 has an elastic contact piece 21 and a first conductive member 22. The elastic contact piece 21 is a flexible metal strip, slightly curved in shape and can be bent toward two opposite directions due to temperature change. The elastic contact piece 21 may be made of a bimetallic material. A first end of the elastic contact piece 21 is fixed to an inner side of the cover 10 and a second end of the elastic contact piece 21 is a free end to bend. The second end of the elastic contact piece 21 is provided with a first contact point 211. The first conductive member 22 is a thin board and a second contact point 221 is disposed on a top of the first conductive member 22. The first contact point 211 is located corresponding to the second contact point 221. The first conductive member 22 includes an assembly hole 223 and a first slot 222 that is defined at a side of the first conductive member 22.

The second protection unit 30 includes a second conductive member 31 that is a flexible thin piece and a fuse member 32. A side of a first end of the second conductive member 31 extends to form two connection pieces 310 and a second slot 311 is defined between the two connection pieces 310. A second end of the second conductive member 31 is a free end 312. The connection pieces 310 are fixedly contacted and electrically connected with the first conductive member 22. The first slot 222 and the second slot 311 are corresponding to each other. The free end 312 of the second conductive member 31 does not contact with a second terminal 34 before the fuse member 32 is disposed in the base 4. The fuse member 32 has one end pressing against the second conductive member 31 to push the free end 312 of the second conductive member 31 to be in contact with the second terminal 34, thereby electrically connecting the second conductive member 31 with the second terminal 34. The second conductive member 31 is flexible. Thus, if the fuse member 32 does not press against the second conductive member 31, the elasticity of the second conductive member 31 can separate the free end 312 from the second terminal 34. Moreover, the second protection unit 30 may further include a biasing member 33 disposed and compressed at a side of the second conductive member 31 opposite to the fuse member 32. When the compressed bias member 33 is relieved to an original un-compressed state, the bias member 33 can enhance the free end 312 separating from the second terminal 34. The bias member 33 according to an embodiment of the present invention is a helical spring.

The base 40 includes a recess 41 defined therein so as to receive the first conductive member 22, the second conductive member 31, the biasing member 33 and the fuse member 32. The base 40 includes a first assembly post 42 and a second assembly post 43 extending from the floor of the recess 41. The base 40 has a slit 44 disposed at a side wall of the base 40, and a depression 45 and a cavity 46 disposed beside the recess 41. The depression 45 and the cavity 46 are opposite to each other. The cavity 46 has a narrow opening.

Figure 5:
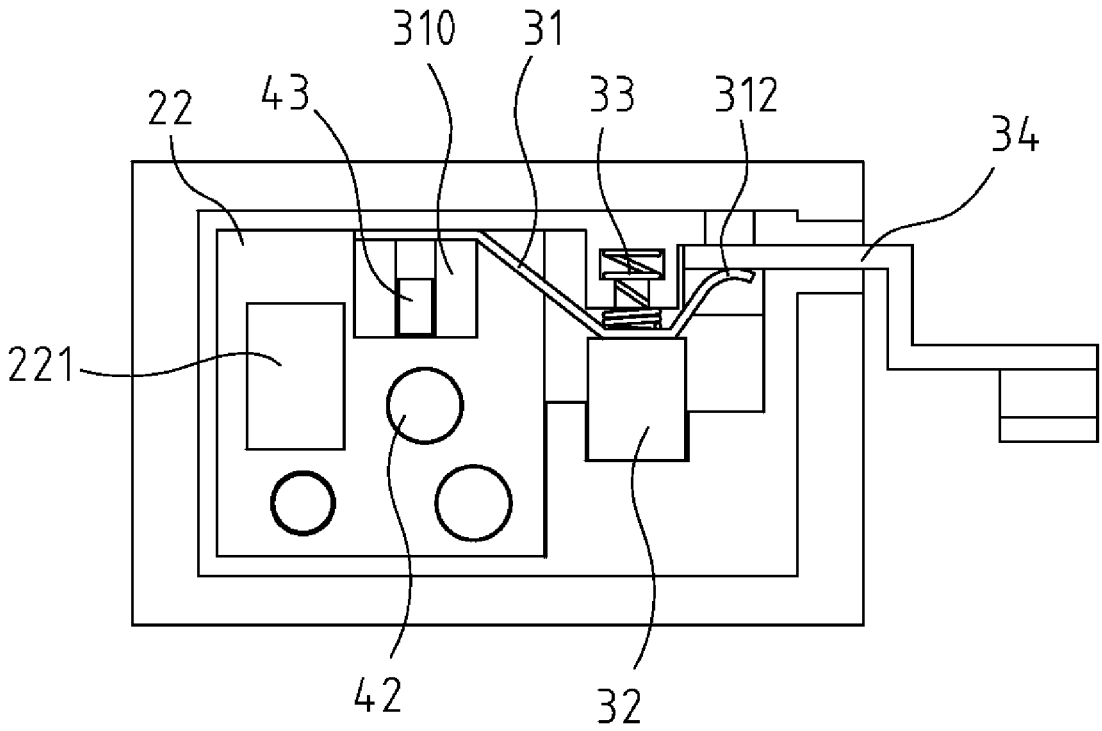
FIG. 5 is a schematic top view showing the dual protection device of FIG. 3, wherein the dual protection device is in a closed circuit state.

Referring to FIG. 5, when the first conductive member 22 and the second conductive member 31 are received in the recess 41, the first assembly post 42 is fitted into the assembly hole 223 of the first conductive member 22 and the second assembly post 43 is fitted into the first and second slots 222, 311. The fuse member 32 is received in the depression 45 and presses against the second conductive member 31. Therefore, the free end 312 of the second conductive member 31 is pushed to contact and electrically connect with the second terminal 34. One end of the biasing member 33 is engaged with the cavity 46 and the other end of the biasing member 33 presses against the second conductive member 31. The second conductive member 31 is located between the fuse member 32 and the biasing member 33. Thus, the compressed biasing member 33 may provide an elastic force to separate the free end 312 of the second conductive member 31 from the second terminal 34. The biasing member 33 is a helical spring and compressed by the fuse member 32.

Figure 6:
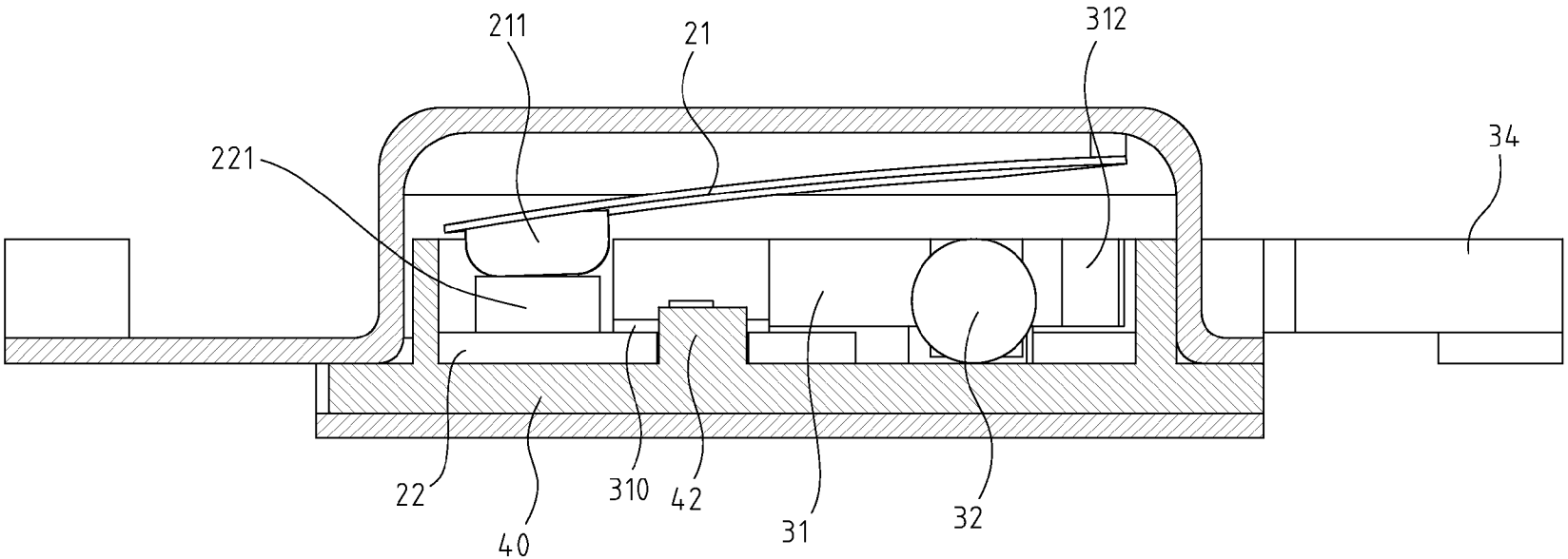
FIG. 6 is a side cross sectional view showing the dual protection device of FIG. 3, wherein the dual protection device is in a closed circuit state.

When the dual protection device is in use, the elastic contact piece 21 bends downward and the first contact point 211 contacts with the second contact points 221. Thus, the electric current passes the first terminal 11, the cover 10, the elastic contact piece 21, the first contact point 211, the second contact point 221, the first conductive member 22, the connection pieces 310, the second conductive member 31, the free end 312 and the second terminal 34 to form a closed circuit as shown in FIGS. 5 and 6.

Figure 7:
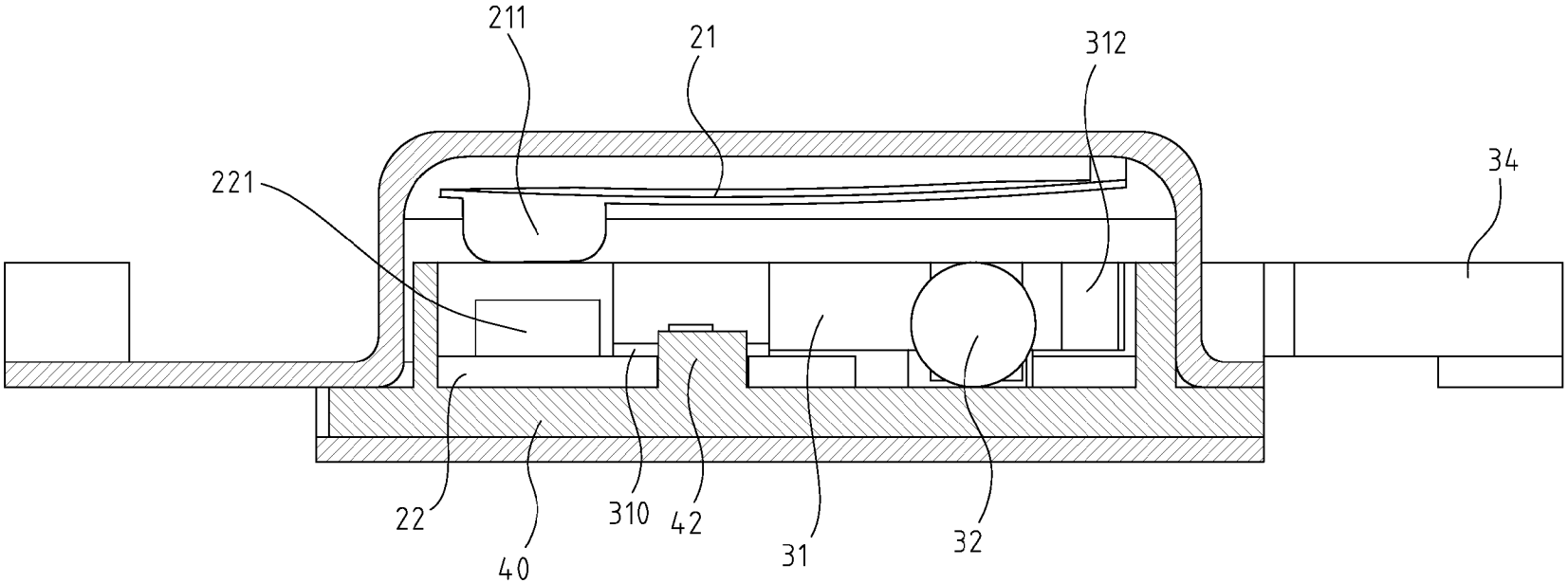
FIG. 7 is a side cross sectional view showing the dual protection device of FIG. 3, wherein a first protection unit cuts off the circuit and the dual protection device is in an open circuit state.

When the circuit is overloaded and reaches a first predetermined temperature, the first protection unit 20 is activated and the elastic contact piece 21 is deformed and bent upward to separate the first contact points 211 from the second contact points 221 as shown in FIG. 7, thereby cutting off the circuit. The circuit becomes an open circuit. When the temperature cools down, the elastic contact piece 21 is deformed and bent downward. Thus, the first contact point 211 and the second contact point 221 are in contact with each other as shown in FIG. 6, and the circuit becomes a closed circuit again.

Figure 8:
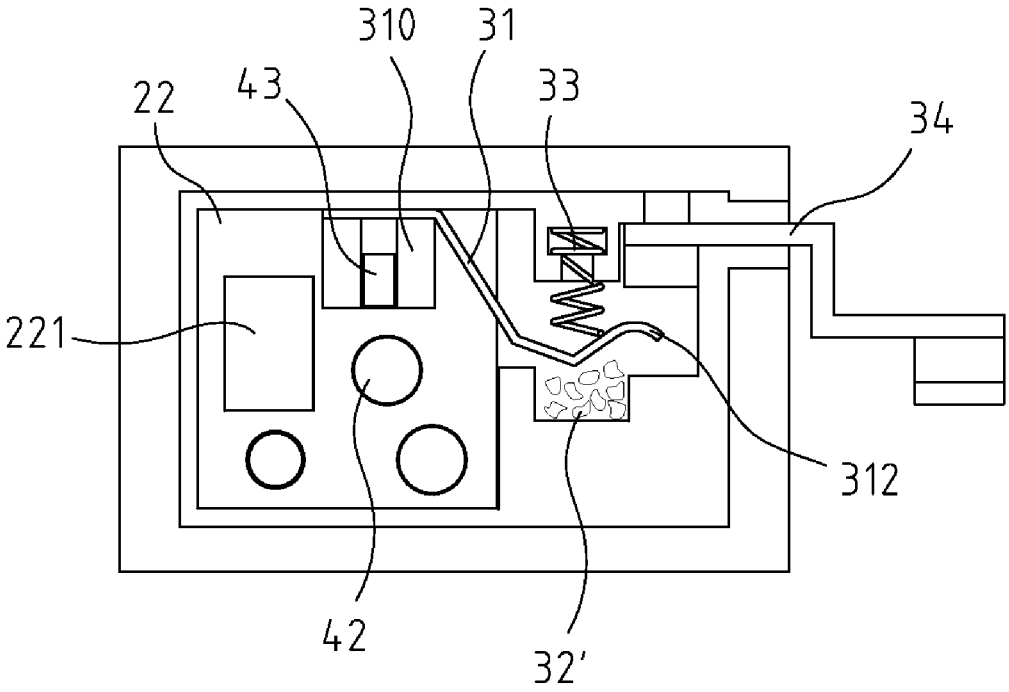
FIG. 8 is a schematic top view showing the dual protection device of FIG. 3, wherein a second protection unit cuts off the circuit and the dual protection device is in an open circuit state.

If the elastic contact piece 21 of the first protection unit 20 does not function properly to cut off the circuit, the temperature of the circuit increases continuously. Then, when the circuit reaches a second predetermined temperature, the fuse members 32 melts and becomes small pieces 32'. Because the second conductive member 31 is flexible and the small pieces 32' no longer force the free end 312 of the second conductive member 31 toward the second terminal 34, the free end 312 of the second conductive member 31 is separated from the second terminal 34 due to elasticity of the second conductive member 31. The compressed biasing member 33 also resumes to its un-compressed state after the fuse member 33 melts. Therefore, the biasing member 33 further pushes the second conductive member 31 away from the second terminal 34 to ensure the circuit being cut off as shown in FIG. 8. In this situation, the circuit becomes an open circuit. Because the fuse member 32 melts, the circuit cannot re-connect again by itself after the temperature cools down. The circuit is permanently cut off.

The first predetermined temperature of the first protection unit 20 is set up lower than the second predetermined temperature of the second protection unit 30. Thus, the dual protection device in accordance with the present invention uses the first protection unit 20 and the second protection unit 30 to provide first-line and second-line protections, respectively. When the circuit is overloaded and reaches the first predetermined temperature, the elastic contact piece 21 of the first protection unit 20 is deformed to separate the first contact point 211 from second contact point 221, thereby protecting the circuit. The second protection unit 30 is activated to cut off the circuit if the first protection unit 20 does not function properly. The fuse member 32 melts when the circuit reaches the second predetermined temperature. Then the free end 312 of the second conductive member 31 is separated from the second terminal 34 due to elasticity of the second conductive member 31 and the biasing member 33. The first protection unit 20 and the second protection unit 30 function independently, and therefore the dual protection device for a circuit according to the present invention ensures the circuit is protected.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A dual protection device for a circuit, comprising:

a cover made of a conductive material and having a first terminal connected thereto;

a first protection unit comprising an elastic contact piece and a first conductive member, the elastic contact piece including a first end fixed to the cover and a second end having a first contact point disposed thereon, the elastic contact piece being made of metal, slightly curved, and capable of bending toward two opposite directions due to temperature change, the first conductive member having a second contact point disposed on a top thereof, the first contact point located corresponding to the second contact point, the first contact point contacted with the second contact point;

a second protection unit having a second conductive member that is a flexible piece and a fuse member, a first end of the second conductive member fixedly contacted and electrically connected with the first conductive member, a second end of the second conductive member being a free end, the fuse member having one end pressing against the second conductive member to push the free end of the second conductive member to be in contact with a second terminal, thereby electrically connecting the second conductive member with the second terminal; and a base having a recess defined therein so as to receive the first conductive member, the second conductive member and the fuse member;

wherein the elastic contact piece of the first protection unit is deformed and bent toward another direction to separate the first contact point from the second contact point when the elastic contact piece reaches a first predetermined temperature; when the temperature of the circuit is raised to a second predetermined temperature, the fuse member melts; the free end of the second conductive member is separated from the second terminal due to elasticity of the second conductive member.

2. The dual protection device as claimed in claim 1, wherein the elastic contact piece is a bi-metallic strip.

3. The dual protection device as claimed in claim 1, wherein the second protection unit further includes a biasing member and the base further includes a cavity, the biasing member has one end engaged with the cavity and the other end contacted with the second conductive member, the biasing member is compressed between the cavity and the second conductive member, the biasing member is capable of pushing the free end of the second conductive member away from the second terminal after the fuse member melts.

4. The dual protection device as claimed in claim 3, wherein the biasing member is a helical spring.

5. The dual protection device as claimed in claim 1, wherein the base comprises a slit disposed at a side thereof and the second terminal is engaged with the slit.

* * * * *